US005797991A

United States Patent [19]

Boockman

[11] Patent Number: 5,797,991

[45] Date of Patent: Aug. 25, 1998

[54] DEVICE FOR COATING A WIRE WITH A LUBRICANT

[75] Inventor: Gerhard Boockman, Niederlauer, Germany

[73] Assignee: Boochmann GmbH, Germany

[21] Appl. No.: 823,479

[22] Filed: Mar. 25, 1997

[30] Foreign Application Priority Data

Apr. 4, 1996 [DE] Germany ..... 196 13 582.6
Oct. 28, 1996 [DE] Germany ..... 196 44 639.2

[51] Int. Cl.[6] ..... B05C 11/00

[52] U.S. Cl. ..... 118/264; 68/200; 118/263

[58] Field of Search ..... 118/234, 271, 118/266, 264, 257, 263; 184/16, 64, 15.1; 68/200; 101/172

[56] References Cited

U.S. PATENT DOCUMENTS 556,786 3/1896 Thompson .
2,513,432 7/1950 Sisson ..... 118/234
4,268,550 5/1981 Williams, Jr. ..... 118/420
4,408,688 10/1983 Bieri ..... 184/16
4,622,241 11/1986 Keys ..... 118/234
4,641,404 2/1987 Seydel et al. ..... 118/234
4,984,440 1/1991 McCall ..... 68/200
5,409,535 4/1995 Boockmann ..... 118/234

*Primary Examiner*—Brenda A. Lamb
*Attorney, Agent, or Firm*—Paul & Paul

[57] ABSTRACT

A device for coating a wire with a lubricant, with a lubricant reservoir (1), an applicator felt (9) in contact with which the wire (5) to be coated runs continuously, and a metering apparatus which supplies a controlled amount of lubricant liquid from the lubricant reservoir (1) to the applicator felt (9), is characterised in that the metering apparatus (12) is provided with at least one metering pin (15) which has an indentation and at controlled intervals alternately on the one hand immerses the indentation into the lubricant liquid in the lubricant reservoir (1) and on the other hand touches the applicator felt (9) in a manner such that with each contact a substantially equal amount of lubricant is absorbed into the applicator felt (9).

14 Claims, 6 Drawing Sheets

DEVICE FOR COATING A WIRE WITH A LUBRICANT

Figure 1:
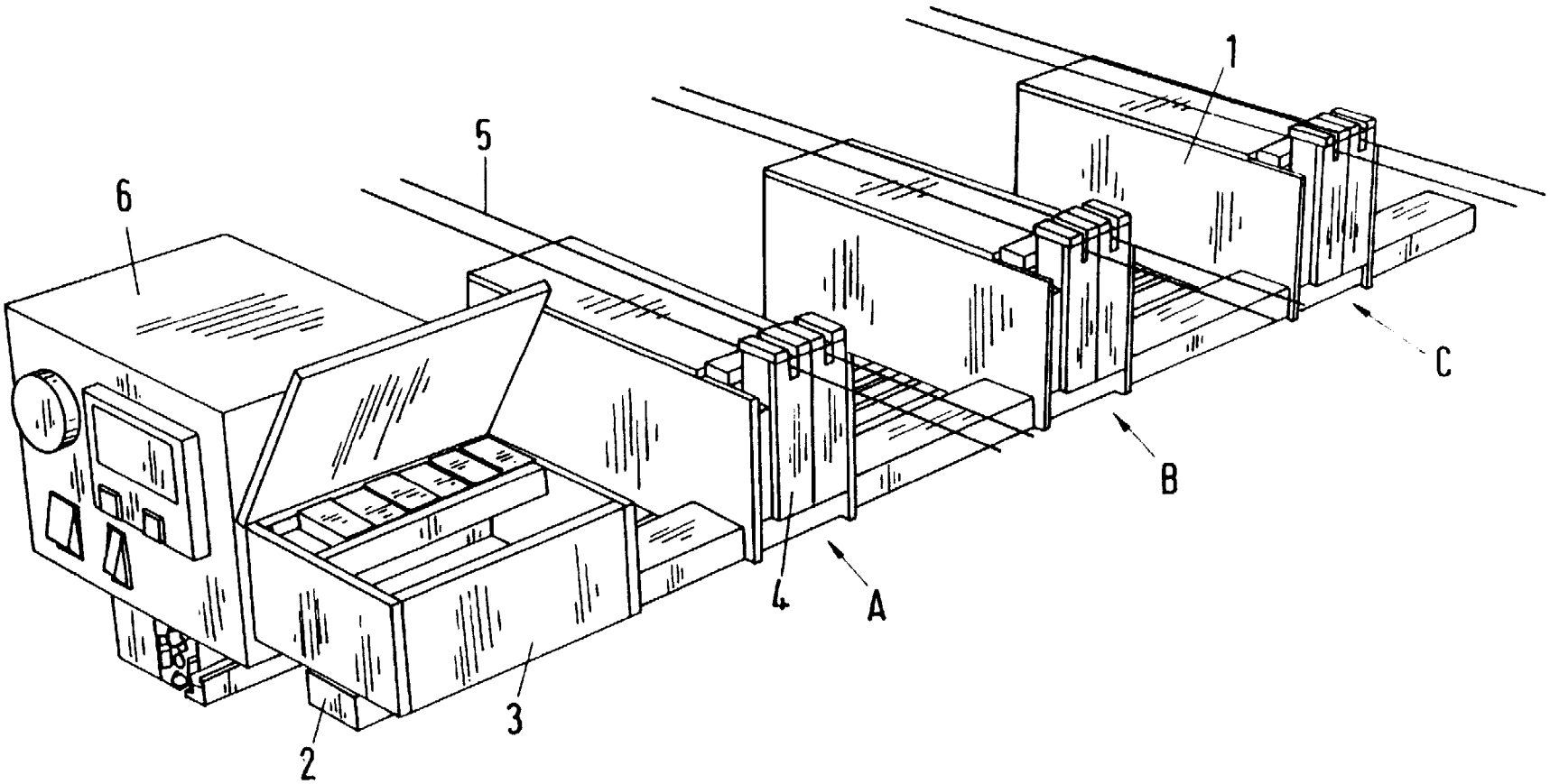

It is known that wires such as electrically insulated winding wires for manufacturing electrotechnical products must have a good sliding quality so that they can be easily and precisely positioned during the manufacture of windings. Furthermore, the electrically insulating layer has to be protected by the sliding quality of the wire during working.

Different processes are known for making wires slidable. Paraffin waxes or paraffin oils are mainly used as the lubricant. In the case of waxes, these are applied to the still hot wire in the form of a molten mass or a solution in benzine or another organic solvent, by means of a felt. When solutions are used the solvent must be evaporated, which entails economic losses because of solvent loss and considerable air pollution in the working area.

In another known process, instead of paraffin solutions, aqueous emulsions or dispersions of paraffin are used, whereby the emission of organic solvents is avoided, however the metering of the emulsions with the aid of a felt is difficult. Such devices are therefore not suitable for applying precisely defined amounts of paraffin to the wire surface. Furthermore, they require an additional drying procedure.

Devices are known for solvent-free application of lubricant to wires with a lubricant reservoir, an applicator felt in contact with which the wire to be coated runs continuously, and a metering apparatus which supplies a controlled amount of liquid lubricant from the lubricant reservoir to the applicator felt. As a rule, the problem with such devices is the metering device. For these, it is known to use solenoid-operated valves or electromagnetically or pneumatically operated piston pumps. Such metering apparatuses, which must supply very small amounts of the liquid lubricant from the lubricant reservoir to the applicator felt, are extremely sensitive to solid particles of dirt, for example scale which is unavoidable with the change in dimension or stoppage of the lacquering unit and can fall into the lubricant reservoir.

A device is known for DE-A-4 134 070 for coating a wire with a lubricant in which the lubricant is applied by means of a strand of material looped around the wire, which material is soaked with the lubricant and is inched along at a slower speed of advance than the wire to be coated. This known device necessitates relatively high investment costs, in particular when slow-running installations are refitted, and is difficult to adapt to installations with very small distances between the wires (harp system). Compared to this known device, the melting devices described in the introduction have the advantage that they make very compact construction possible.

The object of the invention is therefore to provide a device for coating a wire with a lubricant, in particular in the form of a molten mass, which has the simplest possible construction and is not sensitive to solid particles of dirt.

According to the invention, this object is solved with a device for coating a wire with a lubricant reservoir, an applicator felt in contact with which the wire to be coated runs continuously, and a metering apparatus which supplies a controlled amount of lubricant liquid from the lubricant reservoir to the applicator felt, and in accordance with the invention this device is characterised in that the metering apparatus is provided with at least one metering pin which has an indentation and at controlled intervals alternately on the one hand dips with the indentation into the lubricant liquid in the lubricant reservoir and on the other hand touches the applicator felt in a manner such that with each contact a substantially equal amount of lubricant is absorbed into the applicator felt. Advantageously, after filling of the indentation with the liquified or dissolved lubricant, the metering pin brought into contact with the applicator felt sufficiently closely and for sufficiently long for the entire amount of lubricant to be absorbed from the indentation into the applicator felt, although it would also be sufficient to solve the object if with each contact only a part of the amount of lubricant contained in the indentation were transferred to the applicator felt, on condition that this amount transferred with each contact is substantially equal, in order to obtain a constant concentration of lubricant in the applicator felt.

The device for solvent-free application of lubricant is particularly suitable when using a molten wax. The device makes use of the surface tension of the solution or in particular the molten mass of the lubricant, without valves being necessary for the metering, in order to transfer, with the aid of the indentation in the metering pin, the volume of which is precisely pre-determined, an exactly measured amount of lubricant in a pre-determined time cycle from the lubricant reservoir onto the applicator felt.

The indentation on the metering pin can be configured in many different ways and can be, for example, a blind bore, an open, single slot or an open cross-slot. The device can be particularly simply and inexpensively constructed when the metering pins are standard domed-head or round-headed screws, flat-headed screws or Imbus screws, the slots and blind bores in the screw heads of which serve as indentations in the metering pin. Domed or round heads or Imbus screw heads are particularly suitable. Flat heads can sometimes prove problematic because of the formation of a meniscus of melted wax.

The arrangement of the indentation on the metering pin is not crucial per se, as long as it is ensured that the indentation is completely submerged when immersed in the lubricant liquid. However, it is advantageous to arrange the indentation in the area of a free end of the metering pin, as this simplifies the submersion in the lubricant liquid and its dabbing onto the applicator felt.

The alternating submersion of the indentation on the metering pin in the lubricant liquid and its dabbing onto the applicator felt in order for the lubricant liquid to be absorbed from the indentation into the applicator felt is advantageously carried out using a lever and a synchronous motor, advantageously a low voltage synchronous motor. The intervals of the immersion of the free end of the lever with the indentation into the lubricant liquid is determined by the revolution speed, and the combination of the frequency of immersion with the dimension of the indentation produces the amount of lubricant metered to the applicator felt.

Naturally, several metering pins can be provided per lubricant reservoir, which are either simultaneously are or successively immersed in the lubricant liquid. For example, the lever can carry a row of metering pins arranged next to one another and joined together, the free ends of which, with the indentations, are immersed simultaneously in the lubricant liquid in the lubricant reservoir.

A substantial advantage of the device according to the invention is in that its construction is simple, inexpensive and non-sensitive, and even substantial amounts of solid particles in the lubricant liquid, as in the molten wax, do not in practice affect the metering. Scale settles in the lubricant reservoir and can be removed during occasional servicing without the risk of scale particles blocking openings such as valves or the like.

Because as a rule approximately 1 to 10 mg/min of melted or dissolved lubricant has to be transferred onto the applicator felt in order to get the desired amount of lubricant onto the wire to be coated, it is advantageous to keep the volume of the indentation per metering pin within the range of 0.001 to 0.01 $cm^3$. Smaller volumes can produce problems with absorption through the applicator felt because of the capillary action. Larger volumes can be problematic in keeping the liquid in the indentation when emerging from out of the lubricant liquid.

As the device according to the invention is preferably intended for solvent free application of lubricant, a molten lubricant such as molten wax is preferably used, so it is advantageous to heat both the lubricant reservoir and the applicator felt such that premature solidifying of the molten lubricant is prevented. In order to make continuous operation over a longer period of time possible, it is advantageous to continuously or intermittently add lubricant liquid in the form of a solution, and in particular of a molten mass, to the lubricant reservoir and thus keep the level of lubricant in the lubricant reservoir substantially the same. The contact of the applicator felt with the lubricant-filled indentation of the metering pin advantageously takes place every 0.5 to 10 mins, preferably every 1 to 3 mins. The frequency necessary depends on the desired amount to be applied, the running speed of the wire to be coated, the capacity of the indentation on the metering pin and other parameters of the device.

The metering pins need only be very narrow, which not only makes a compact installation possible, but also makes possible a narrow wire spacing even with harp systems, so the devices according to the invention are particularly suitable for such harp systems for coating a plurality of wires running parallel to one another.

The applicator felt advantageously has a volume of 1 to 10 $cm^3$ per metering pin and per wire to be coated. Where there is an applicator felt for several wires, the given volume is multiplied by the total number of wires. The applicator felts must be changed from time to time, and this can be speeded up if the felt is pre-impregnated with the lubricant and calibrated by expression to approximately the balanced state.

In order to calculate the lubricant application, by firstly dabbing the metering pin used onto a previously weighed felt which is not yet saturated with lubricant, the amount of lubricant which can be transferred onto the applicator felt with each contact is determined. For example, when using a dome-headed screw with an M3 cross-slot approximately 5 mg is transferred, with an M3 slot screw approximately 3 mg per contact. The amount of lubricant transferred to the wire when a solvent-free molten lubricant is used is calculated according to the following equation:

$$M = \frac{m \times 1000}{t \times V \times D \times \pi}$$

wherein

M=Amount of lubricant per square meter of surface of wire in $mg/m^2$ t=Minutes per stroke of the lever-operated metering pins m=Mass of lubricant per stroke V=Running speed of wire in m/min D=Diameter of wire in millimeters In an example of an application a 0.5 mm copper wire is lacquered at 150 m/min. The metering pin supplies 5 mg of wax to the applicator felt per stroke. The metering pin makes a stroke every 2 minutes. A lubricant coating of approximately 13 $mg/m^2$ is produced.

The metering pin can touch the applicator felt from any direction in order to absorb the lubricant liquid from the indentation in the metering pin into the felt. For example, the metering pin can contact the applicator felt from above, from below or from the side. However from a constructional point of view it is easiest to arrange the lubricant reservoir below the applicator felt and to allow the metering pin to touch the felt from below.

Problems occasionally occur with the device according to the invention when the applicator felt can no longer compensate for a slackening pressure on the wire to be coated caused by surface wear, as its restorative capability is limited. This means that in such cases the applicator felt often has to be replaced, such as at intervals of a few days.

Another problem can occur during the coating of cold wires. If the temperature of the wire is far enough below the melting point of the lubricant that the heat conductivity of the felt is no longer sufficient to compensate for the energy drawn from the felt, a tube of solidified lubricant forms around the wire, so that penetration to the surface of the wire is prevented. This problem often occurs in practice with wire lacquering machines with a vertically arranged furnace, in which the furnace outlet is usually several meters above the level of the operatives. The problems of application of lubricant to the cold wire can also occur in processes based on solutions of lubricant, because over-saturation of the solution caused by evaporation of the solvent around the felt and thus clogging of the felt around the wire can be observed.

To overcome such problems which may possibly occur, it is preferable that according to the invention in the area of the applicator felt, advantageously in the area in which the running wire is on contact with the applicator felt, the device has a means for heating the wire to be coated. It is particularly preferable when this means for heating the wire is a means which produces friction heat on the surface of the running wire, as in this way an additional external heat source is avoided. The heat produced on the surface of the wire has to compensate for the energy drain into the wire sufficiently to prevent solidifying of the lubricant.

A particularly simple and therefore advantageous embodiment of this feature of the device according to the invention is in that the means producing friction heat is a flexible strand of material surrounding the wire in the area of the applicator felt in the form of at least one loop, pressed under tension onto the surface of the wire. By means of being pressed onto the surface of the wire, friction heat is produced in the looped strand of material during the continuous running through of the wire. The amount of friction heat produced can be controlled by the total number of loops of the strand of material surrounding the wire, the contact pressure, the thickness and the material of the strand of material.

A braided cord as is available in the textile industry, can be considered as the strand of material, made, for example of viscose. For example, this can be a tubular braided hollow cotton braid made from 21 individual cords which are made from a yarn made of two twisted threads with a weight of 24 mg/m. Numerous other materials can naturally also be considered.

The strand of material is arranged in a stationary manner, wherein it usually wrapped several times around the wire. Advantageously the strand of material can be fixed shortly in front of the beginning of the contact between the running wire and the applicator felt, wherein after the strand of material and the wire leave the applicator felt a weight is attached to the other end of the strand of material in order to provide tension and thereby contact pressure on the surface of the wire.

For example, with a wire temperature of 30° C., a lacquering speed of 30 m/min, a wire diameter of 1 mm and a melting temperature of wax of 80° C., wrapping around five times and weighting with a 200 g weight is sufficient to ensure constant complete wetting.

The invention will be described further with reference to the drawings. In these there is shown in FIG. 1 a perspective view of a wire coating device according to the invention with three coating stations, FIG. 2 a perspective view of a coating station according to the invention for simultaneous coating of six wires in a harp system, FIG. 3 a side view of the coating station shown in FIG. 2, FIG. 4*a* a side view, and FIG. 4*b* a plan view of a part of a metering pin according to the invention with the indentation according to an embodiment of the invention, and FIG. 5*a* a perpendicular section, FIG. 5*b* a plan view of a metering pin according to another embodiment of the invention, and FIG. 6 a side view of a modified coating station according to the invention.

The unit shown in FIG. 1 is provided with three coating stations A, B and C running parallel to one another, each for coating two parallel wires. Each of the coating stations A, B and C is provided with its own heated lubricant reservoir 1, in which the liquid wax used as the lubricant is located. The lubricant reservoirs are supplied with liquid lubricant by means of the rectangular conduit 2 and the feed bowl 3 which also serves to calibrate the felt. Each coating station A, B, C is provided with two felt holders 4 with the applicator felt through which the wire 5 to be coated runs. The temperature of the lubricant reservoir and the operating speed can be controlled with the aid of the control box 6 with a controller and a transformer.

Figure 2:
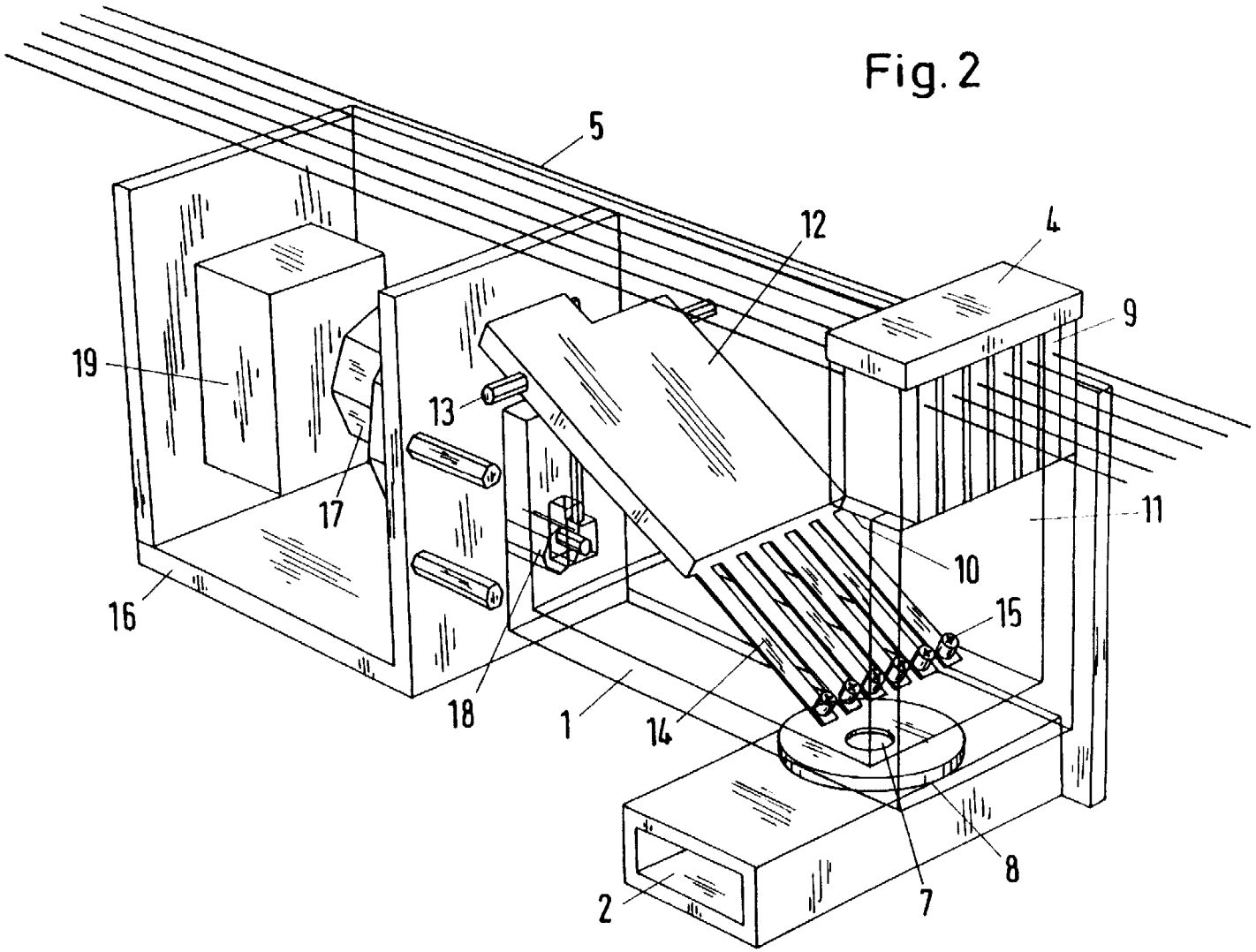
Figure 3:
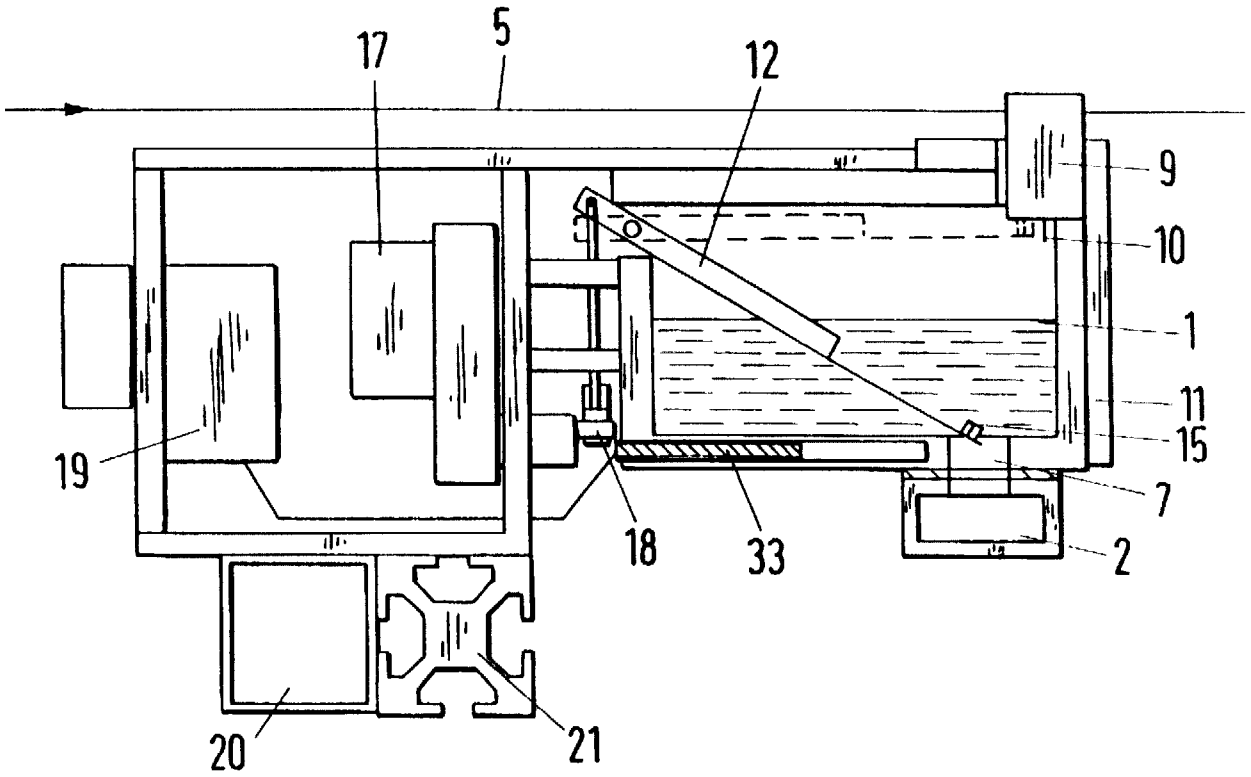

FIGS. 2 and 3 show, partly cut away, a perspective view of a coating station according to another embodiment of the invention for coating six wires in a harp system. Common parts are shown with the same reference numerals in FIGS. 2 and 3 as in FIG. 1.

The device is provided with a lubricant reservoir 1, which contains the molten wax for use as the lubricant. The lubricant reservoir 1 is topped up with molten lubricant by means of the rectangular conduit 2 and the opening 7. The connection between the rectangular conduit 2 and the opening 7 in the base of the lubricant reservoir 1 is sealed by means of the seal 8.

The felt holder 4 with six felts 9, through which the six wires 5 to be coated pass, is arranged above the lubricant reservoir. A part 10 of the lower end of the felts 9 projects beyond the front wall 11 of the lubricant reservoir 1 towards the inside. A lever 12 is arranged in the lubricant reservoir 1 rotatably about a rotary axis 13 in such a way that the metering pins 15 fixed on flat springs 14 on the lever 12 alternately dip into the molten lubricant and dab or touch the projecting part 10 of the felts 9, wherein the amount of wax trapped in the indentations in the metering pins 15 when immersed in the molten mass is transferred onto the felts 9, in that this amount of wax is absorbed from the indentation in the metering pin by the absorbent felt.

A synchronous motor 17 which drives the cam 18 is located in the housing 16. Said cam produces the movement of the lever 12 about its rotary axis 13 into the two end positions, wherein in one end position, the metering pins 15 are immersed in the molten wax and in the other end position dab the overhang 10 of the felts 9. In the housing 16, a further thermostat 19 is shown schematically, with the aid of which the temperature control of the entire device is provided such that the lubricant is in the liquid state until the moment when the wires 5 leave the felts 9. This means that the entire coating station shown in FIGS. 2 and 3 is arranged in an outer housing, the internal volume of which is heated by heating cartridges 33. FIG. 3 shows, in addition to the parts described above, a cable channel 20, a fixing profile 21 and one of the heating cartridges 33.

FIG. 3 also shows the lever 12 with the metering pins 15 in its two end positions, wherein the end position with the immersed metering pins 15 is shown in solid lines and the end position with the metering pins lying on the felts 9 in broken lines.

Figure 4B:
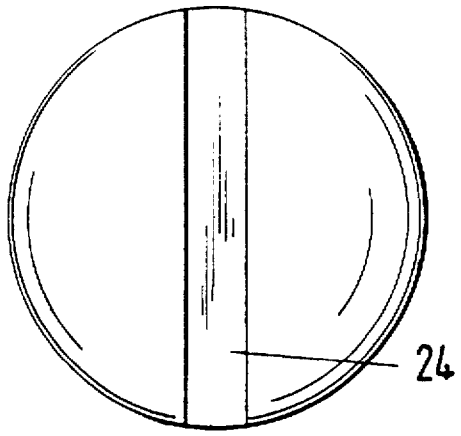
Figure 4A:
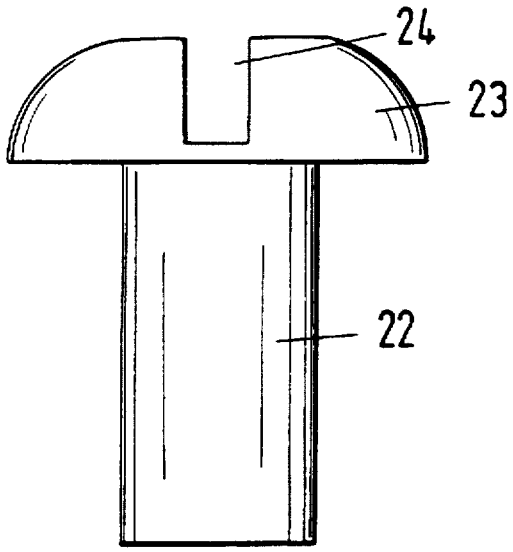
Figure 5B:
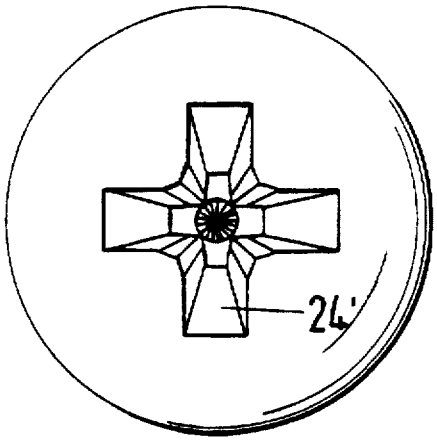
Figure 5A:
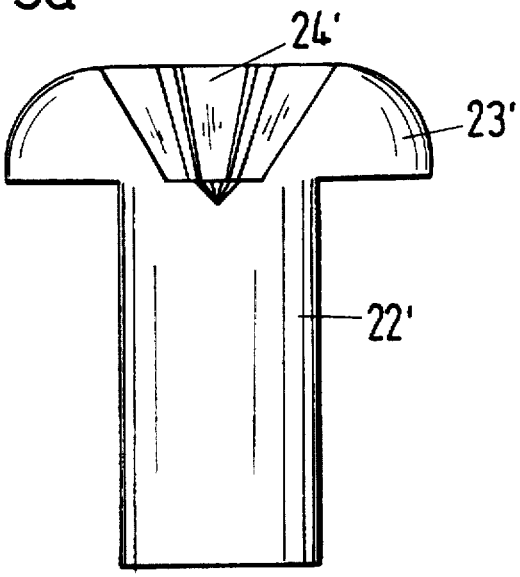

Two embodiments of metering pins according to the invention are shown on the one hand in FIGS. 4*a* and 4*b* and on the other hand in FIGS. 5*a* and 5*b*. The embodiment of a metering pin shown in FIGS. 4*a* and 4*b* has a domed head 23 on a shank 22 with an indentation 24 in the form of an open, single slot.

The embodiment shown in FIGS. 5*a* and 5*b* correspondingly has a domed head 23' on a shank 22' with a central indentation 24' in the form of a cruciform blind bore.

Standard, commercially available slotted or Imbus screws can be used as metering pins. The indentations in the metering pins for receiving the liquid lubricant can be of any shape.

Figure 6:
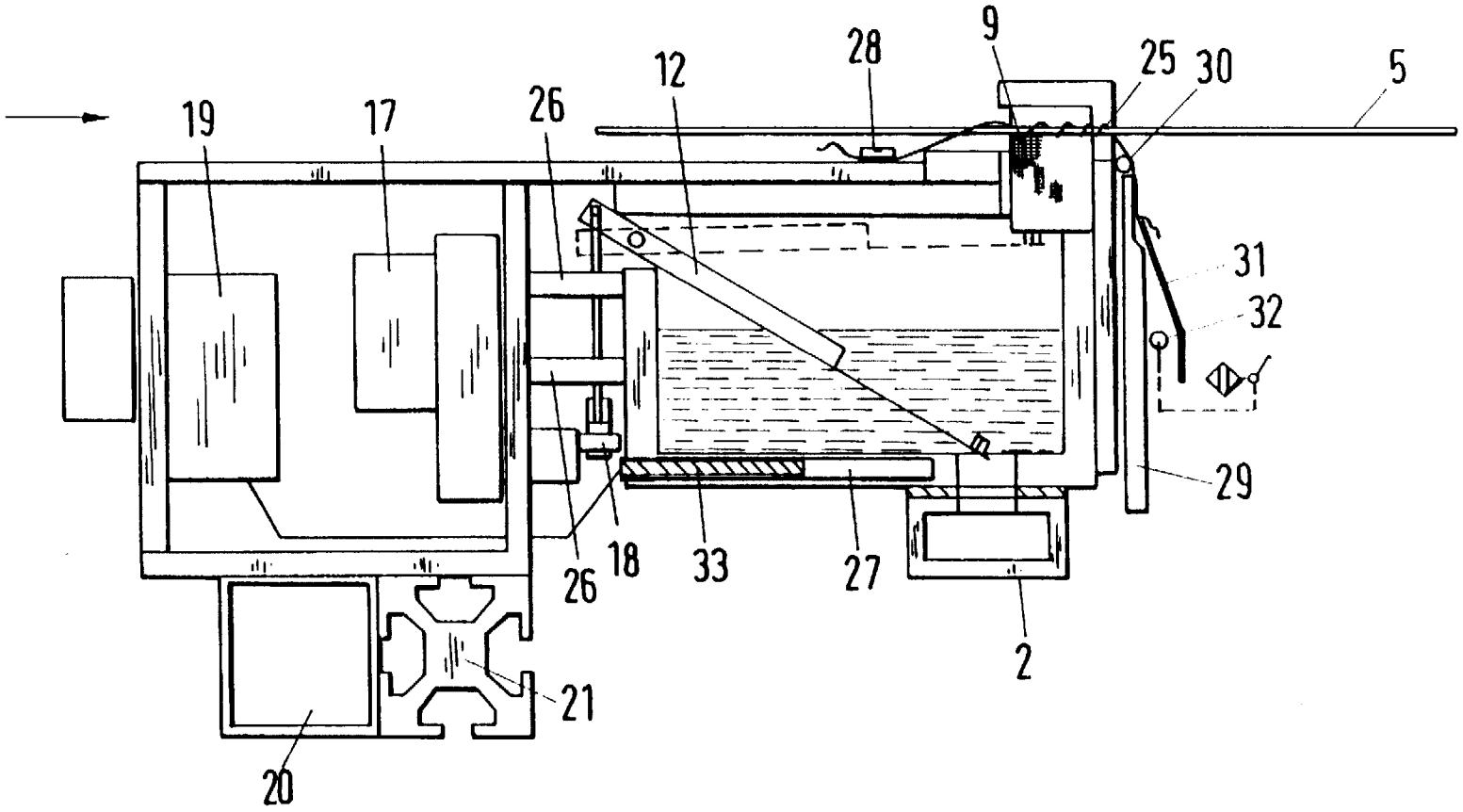

The modified coating station shown in FIG. 6 corresponds to that shown in FIG. 3, and for this reason the same reference numerals are used for common components.

In addition to the components described with reference to FIG. 3, and the supporting bolts labelled 26 and the capillary tube labelled 27, a flexible strand of material 25 is wrapped around the continuously running wire 5 in the form of four loops in the area of contact between the wire 5 and the applicator felt 9. One end of the strand of material 25 is fixed with a clamping screw 28. At the other end of the strand of material 25 a weight 29 is attached so that the loops of the strand of material surrounding the wire 5 are pressed onto the surface of the running wire and thus produce friction heat.

Behind the applicator felt 9 the strand of material according to FIG. 6 is guided around a diverting mandrel 30 and has on its end a clamping spring 31. In addition a control lever 32 is provided.

I claim:

1. A device for coating wire with a lubricant liquid, including a lubricant reservoir for containing the lubricant liquid, an at least one applicator felt, means for continuously moving at least one wire to be coated with the lubricant liquid into contact with the applicator felt, and a metering apparatus which supplies a controlled amount of lubricant liquid from the lubricant reservoir to the applicator felt, wherein the metering apparatus is provided with at least one metering pin which has an indentation therein, and means for, at controlled intervals, immersing the indentation into the lubricant liquid in the lubricant reservoir, and then contracting the applicator felt with the at least one metering pin having the lubricant liquid contained in the indentation in such a manner that a substantially equal amount of lubricant liquid is absorbed into the applicator felt.

2. A device according to claim 1, wherein the indentation of the at least one metering pin comprises one of:

(a) a blind bore;

(b) an open single slot; and (c) an open, cross-slot.

3. A device according to claim 1 or 2, wherein the at least one metering pin has a free end and wherein the indentation is provided on said free end.

4. A device according to one of claims 1–2, wherein the at least one metering pin is in the form of a standard screw.

5. A device according to one of claims 1–2, wherein the indentation of the at least one metering pin has a volume of 0.001 to 0.01 $cm^3$.

6. A device according to one of claims 1–2, wherein said means for immersing the indentation and for contacting the applicator felt is comprised of a lever, wherein the at least one metering pin is carried by said lever pivotable between two end positions, wherein in one end position the at least one metering pin is immersed with its indentation in the lubricant liquid in the lubricant reservoir, and in the other end position is in contact with the applicator felt.

7. A device according to one of claims 1–2, including means for heating the lubricant reservoir.

8. A device according to one of claims 1–2, including means for heating the applicator felt.

9. A device according to one of claims 1–2, further comprising a common holder, and wherein a plurality of said metering pins are arranged on the common holder, and wherein each metering pin engages a portion of said at least one applicator felt.

10. A device according to one of claims 1–2, wherein the lubricant reservoir is provided with a means for addition of lubricant thereto.

11. A device according to one of claims 1–2, wherein a timing means is provided for producing contact of the metering pin with the applicator felt every 0.5 to 10 minutes.

12. A device according to one of claims 1–2, wherein means are provided, operatively associated with the applicator felt, for heating the wire to be coated.

13. A device according to claim 12, wherein the means for heating the wire comprises a means producing friction heat on the surface of the wire.

14. A device according to claim 13, wherein said means for producing friction comprises a flexible strand of material surrounding the wire in a form of a loop and means pressing said flexible strand of material and the surface of the wire together under tension.

* * * * *